US005139081A

United States Patent [19]

Schuurman

[11] Patent Number: 5,139,081

[45] Date of Patent: Aug. 18, 1992

[54] CHEMICAL HEAT PUMP SYSTEM

[76] Inventor: Eiko A. Schuurman, P.O. Box 645, 3430 AP Nieuwegein, Netherlands

[21] Appl. No.: 745,546

[22] Filed: Aug. 15, 1991

[51] Int. Cl.[5] ..... F25B 30/00; F28D 21/00

[52] U.S. Cl. ..... 165/104.12; 62/114; 62/500

[58] Field of Search ..... 165/104.12; 62/500, 62/114

[56] References Cited

U.S. PATENT DOCUMENTS

| | | | |
|---|---|---|---|
| 3,370,420 | 2/1968 | Johnson | 165/104.12 |
| 3,967,676 | 7/1976 | Spacil | 165/104.12 |
| 4,044,821 | 8/1977 | Fletcher | 165/104.12 |
| 4,347,891 | 9/1982 | Chubb | 165/104.12 |
| 4,765,148 | 8/1988 | Ohashi | 62/114 |
| 4,951,741 | 8/1990 | Schuurman | 165/104.12 |

*Primary Examiner*—Albert W. Davis, Jr.

*Attorney, Agent, or Firm*—Leonard Belkin

[57] ABSTRACT

This invention discloses an extremely simple chemical heat pump system utilizing the chemical reaction heat of a perfectly reversible chemical disassociation reaction system wherein one gaseous compound is involved in the reversible reaction. The present system can realize a large coefficient of performance over a very attractive temperature range and level for general use, by absence of any phase transition. Reaction kinetics of the system are excellent since only one reversible non-flammable gaseous compound is involved in the chemical heat pump system. The system can be provided with a computer controlled system for changing the restriction value of the expansion valve. The system utilizes jet ejectors in combination with the compressor in the same or different loops to reduce the capacity requirements on the compressor.

6 Claims, 6 Drawing Sheets

CHEMICAL HEAT PUMP SYSTEM

BACKGROUND OF THE INVENTION

This invention is an improvement over the invention in my U.S. Pat. No. 4,951,741 issued on Aug. 28, 1990 which is incorporated herein by reference.

The chemical heat pump system shown in my patent relies on a preheating system with a compressor to obtain the high pressures required without liquefaction. For the system to operate effectively, the compressor must have a very large capacity and operate at a high pressure ratio, if a large temperature increase is wanted. A second compressor is needed if the heat pump system is used for cooling purposes.

SUMMARY OF THE INVENTION

In this invention it is possible to reduce the capacity and pressure loading requirements of the compressor by introducing the use of one or more jet ejectors.

Before describing how the jet ejector is employed in the present invention, first some jet ejector information. The velocity of a fluid stream enables it to do useful work. Jet ejectors and injectors, which use the velocity energy of one fluid to move another fluid against a pressure head, are well-understood in the art. Piston pumps are expensive to maintain and especially high vacuum positive displacement pumps are very expensive and large. Today, jet ejectors are preferred vacuum-producing devices for many applications, but until now have been not used in a chemical heat pump system combined with a compressor forming a hybrid system.

A jet ejector has two inlets. One goes to a nozzle for the motive fluid which is at a high pressure. The other inlet admits a flow of material at a lower pressure to be evacuated or pumped. That flow is usually a gas-vapor mixture. Energy is transformed by the motive fluid exceeding the speed of sound as it leaves the nozzle. With essentially all of its energy in the form of velocity energy, it enters the suction chamber at the design suction pressure. As the jet of motive fluid streaks into the inlet portion of the diffuser, its vacuum induces the gas-vapor mixture to flow into the ejector inlet. Inlet flow then becomes entrained with the motive fluid jet flow. They mix while they traverse the converging inlet-cone of the diffuser. The motive fluid slows down and the gas-vapor stream picks up speed. At some point in the throat of the diffuser, the combined flow of motive fluid and inlet-gas-vapor reaches exactly the speed of sound. A stationary sonic-speed shock wave forms there. It produces a sharp rise in absolute pressure at this zone in the diffuser throat.

In the tapered-out discharge cone of the diffuser, flow velocity of the mixture decreases gradually. Velocity energy is converted back into additional pressure energy during the smooth slow down. The net result of these energy transformations is to raise the absolute pressure of the mixture at discharge to several times the pressure at which the lower pressure fluid entered the ejector inlet. A substantial flow can be maintained with a pressure ratio of ten to one, or higher. By staging jet ejectors, it is possible to attain a suction pressure as low as 0.001 mbar.

A preferred embodiment of this invention comprises a chemical heat pump system having a compressor and an exothermic reactor tank/heat exchanger formed into a main loop utilizing the chemical reaction heat of a perfectly reversible chemical dimerization reaction system having only one (gaseous) compound characterized by a controlled variable expansion valve and means for controlling the expansion of said valve as a function of the desired end temperatures of the system, the improvement comprising at least one jet ejector working in cooperation with said compressor.

It is thus an object of this invention to provide a chemical heat pump system employing jet ejectors with a single reactant operating in the vapor phase and relying on an association-dissociation reaction.

Other objects of this invention will hereinafter become obvious from the following description of preferred embodiments of this invention.

DESCRIPTION OF THE PREFERRED EMBODIMENTS

Figure 1:
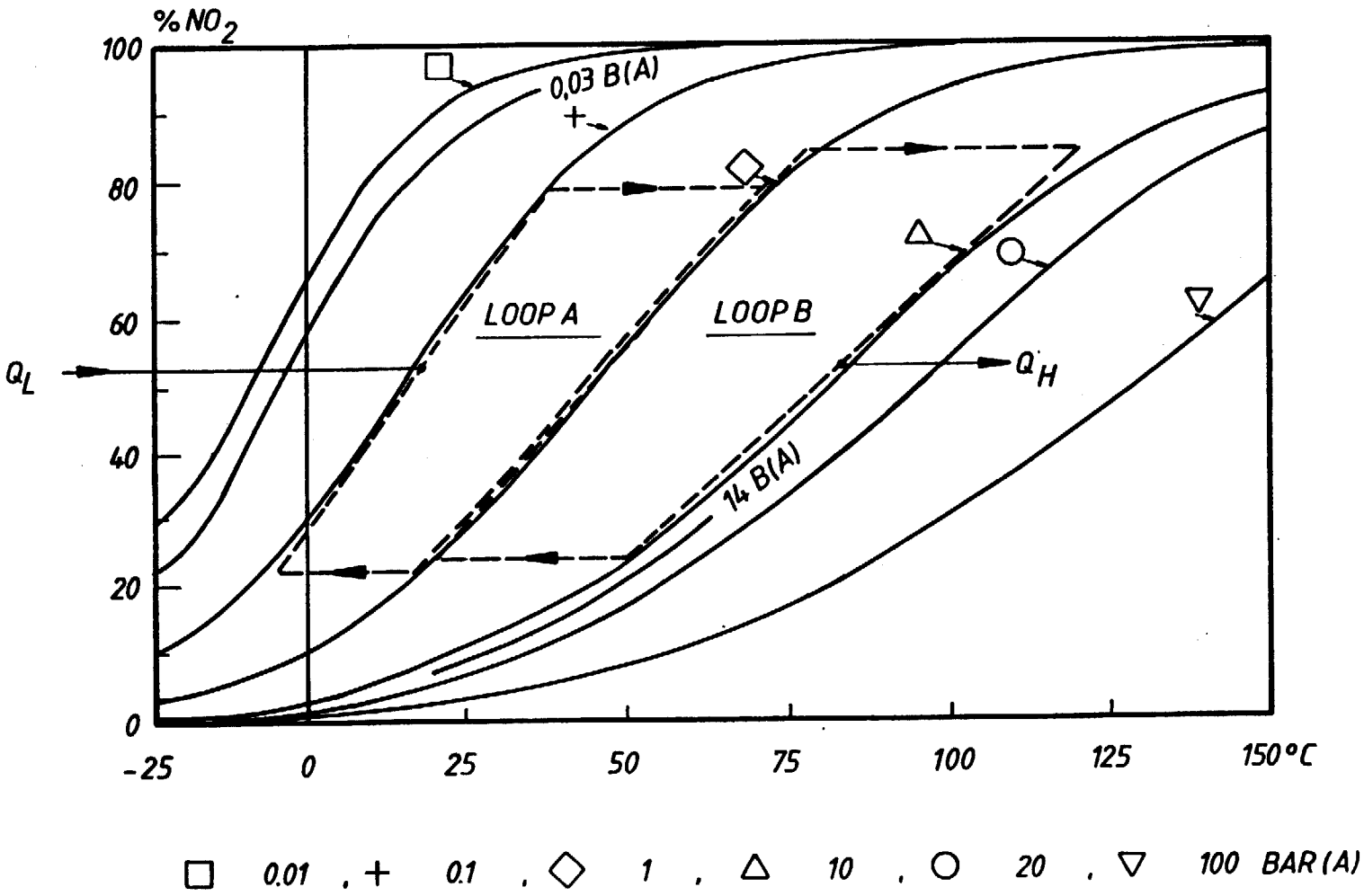
FIG. 1 is the fundamental diagram, explaining the working principles of the chemical heat pump system, by combining a single stage jet ejector with a compressor, showing the maximum average attainable temperature difference, in one step being 70 degrees C., for $NO_2$ in the range of 22% to 82% (60% chemical reaction band) of the working fluid.

It can be seen in FIG. 1, if a rather wide temperature range is to be achieved, the pressure range is increasing too. Especially with regards to pressures below atmospheric, it is very costly and rather impossible to find a compressor on the market covering pressures from 0.1 Bar(A) up to 14 Bar(A).

To operate in the range of from approximately 0.1 Bar(A) to 1 Bar(A) the ejector is used. By using the ejector, the pressure ratio across the compressor being 1:140 is brought down to 1:14. It is well known that by lowering pressure ratio the performance of a compressor goes up, while drive energy declines sharply.

By the use of multi-stage jet ejectors, it can be seen in FIG. 2 that a wide temperature range is achieved at rather low temperature, far below zero degrees C. The pressure of the working fluid goes down to 0.03 Bar(A) at a low mass content of the fluid. Reaching a reasonable (mass) flow capacity demands a huge displacement at a high compression ratio, meaning a very large heavy and expensive vacuum pump is required. To avoid that, multi-stage jet ejectors are used instead, bringing down investment costs (and maintenance costs) sharply. In some cases even the operational costs are not increased due to the fact that the compression ratio over the compressor has been brought back, from approximately 1:466 to 1:14 since the staged jet ejectors are covering pressures from 0.03 Bar(A) to 0.25 Bar(A) (ejector no. 8) and 0.15 Bar (A) to 1,1 Bar (A) (ejector No. 9) (seen in FIG. 4), each of the ejectors having a pressure overlap of 0.1 Bar.

In FIG. 1 it can be seen that in the case of a single stage jet ejector/compressor chemical heat pump system, the temperature rise together with the wide chemical reaction band promise quite an improvement in comparison with most other diagrams (FIG. 1 thru FIG. 4 in U.S. Pat. No. 4,951,741).

Figure 2:
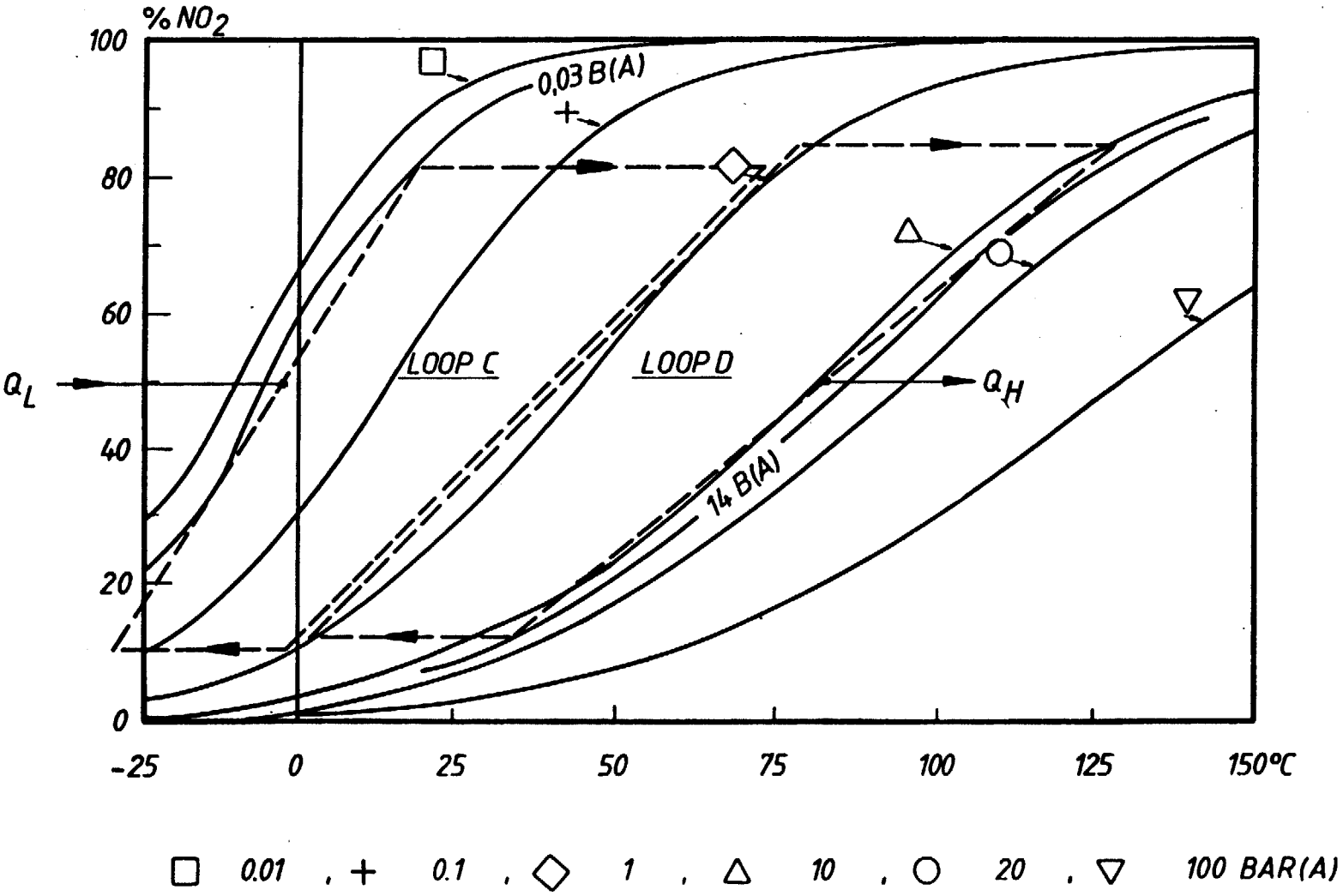
FIG. 2 is the same diagram, showing an average temperature difference of 92 degrees C., using a double loop-multi-stage jet ejector with a compressor (see FIG. 6), at a 72 wide chemical reaction band.

FIG. 2 shows even better results by using multi-stage jet ejectors in the system.

Figure 3:
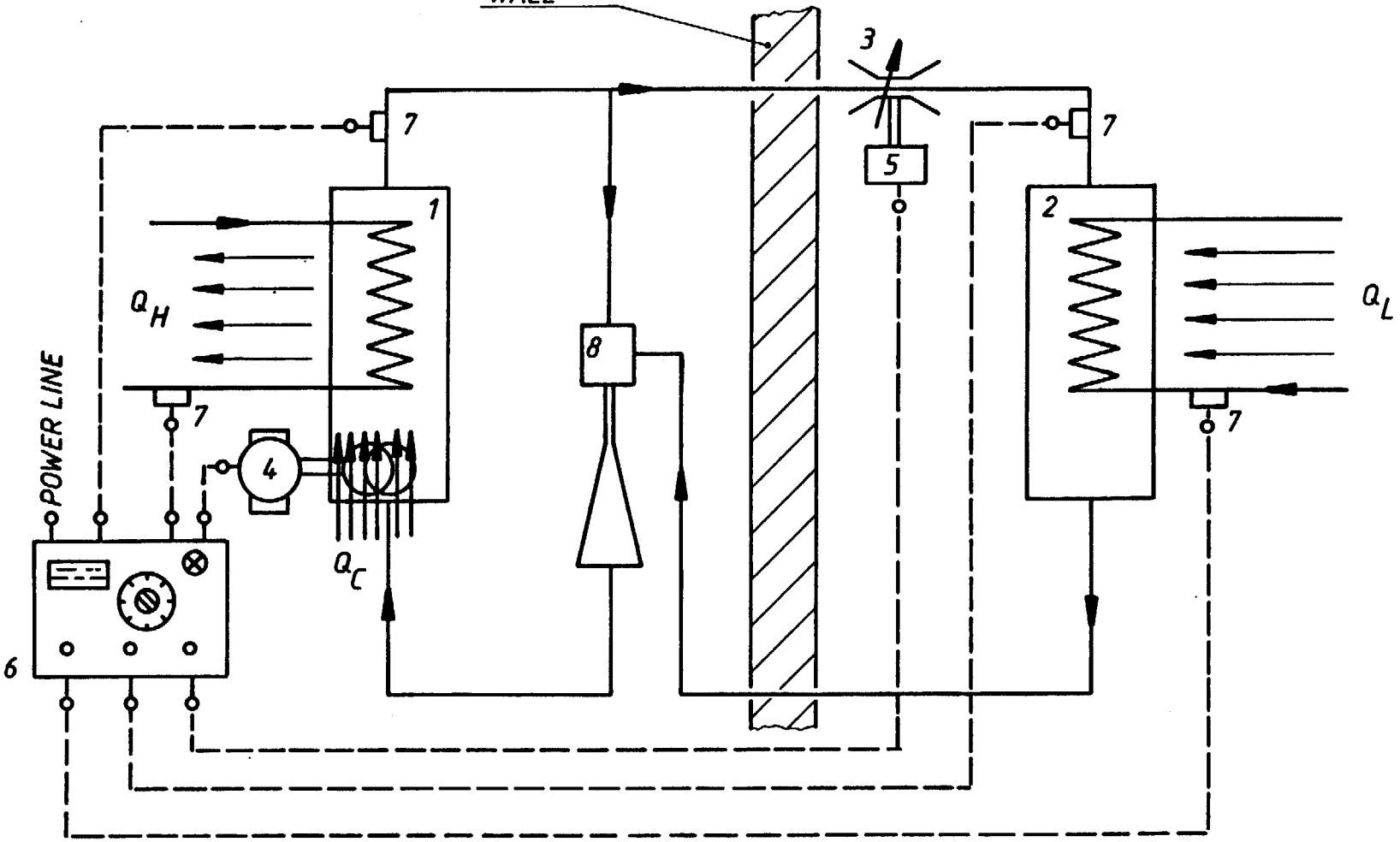
FIG. 3 is a schematic drawing of the chemical heat pump system of this invention, combining a jet ejector in series with a compressor.
Figure 4:
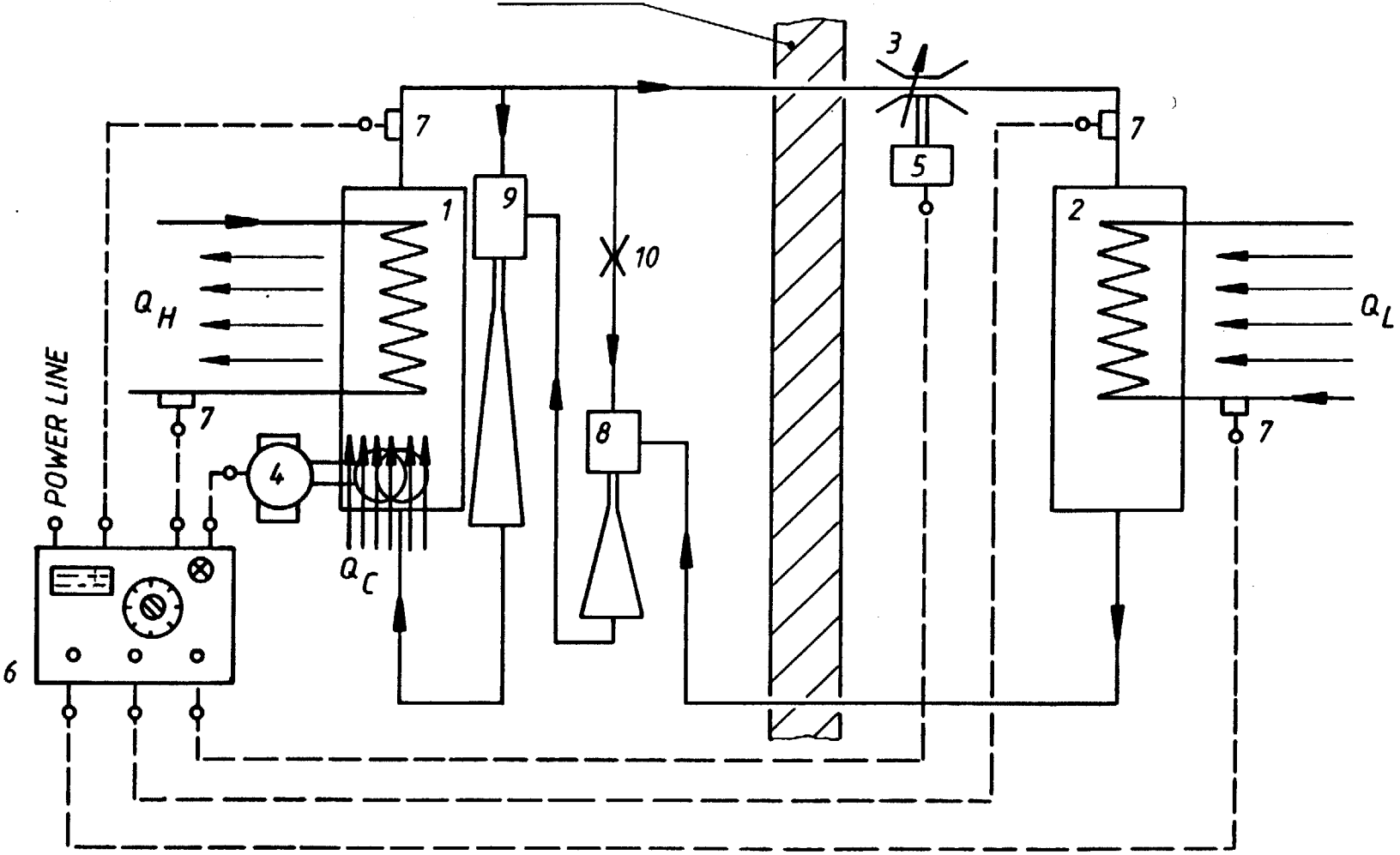
FIG. 4 is a schematic drawing of the chemical heat pump system, combining multi-stage jet ejector in series with a compressor, wherein symbol 10 is a fixed restriction.

Referring to FIG. 3, the use of one jet ejector 8 together with a compressor brings important advantages over the use of the compressor as a stand alone. As seen in FIG. 4, a second jet injector 9 can be added in series to jet ejector 8.

Figure 5:
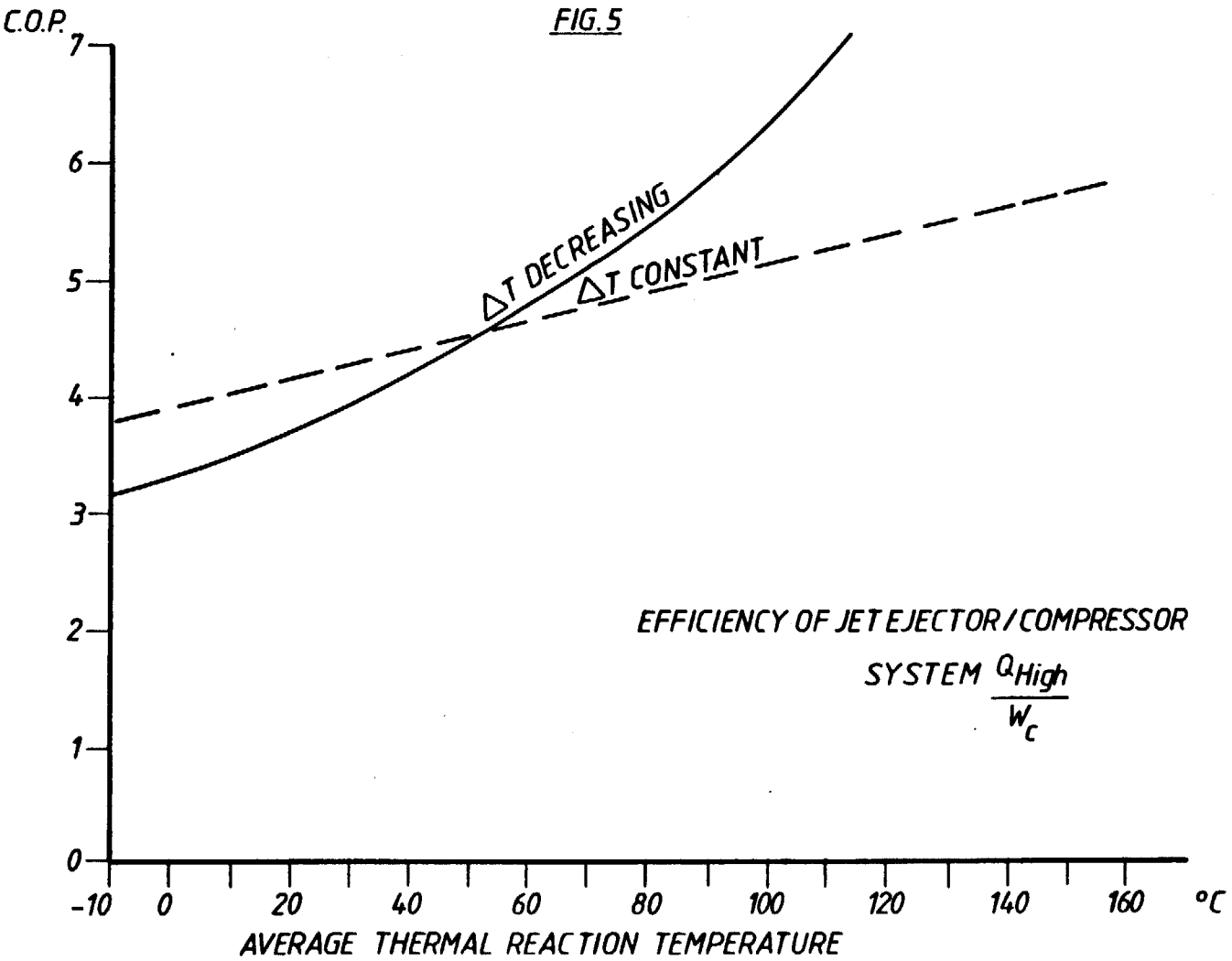
FIG. 5 is a plot showing the improved coefficient of performance (C.O.P.) of the chemical heat pump system, using the multi-stage jet ejector/compressor system.

FIG. 5 expresses the far better results (C.O.P), by introducing jet ejector(s) and a double loop into the chemical heat pump system. It can be expected, due to the above mentioned improvements, that heat pump investment costs are cut by approximately 30 , while operating costs of the heat pump decline sharply.

The C.O.P. number has been increased from 3.0 up to 4.4 at 70 degrees c. (See FIG. 5 in U.S. Pat. No. 4,951,741).

Figure 6:
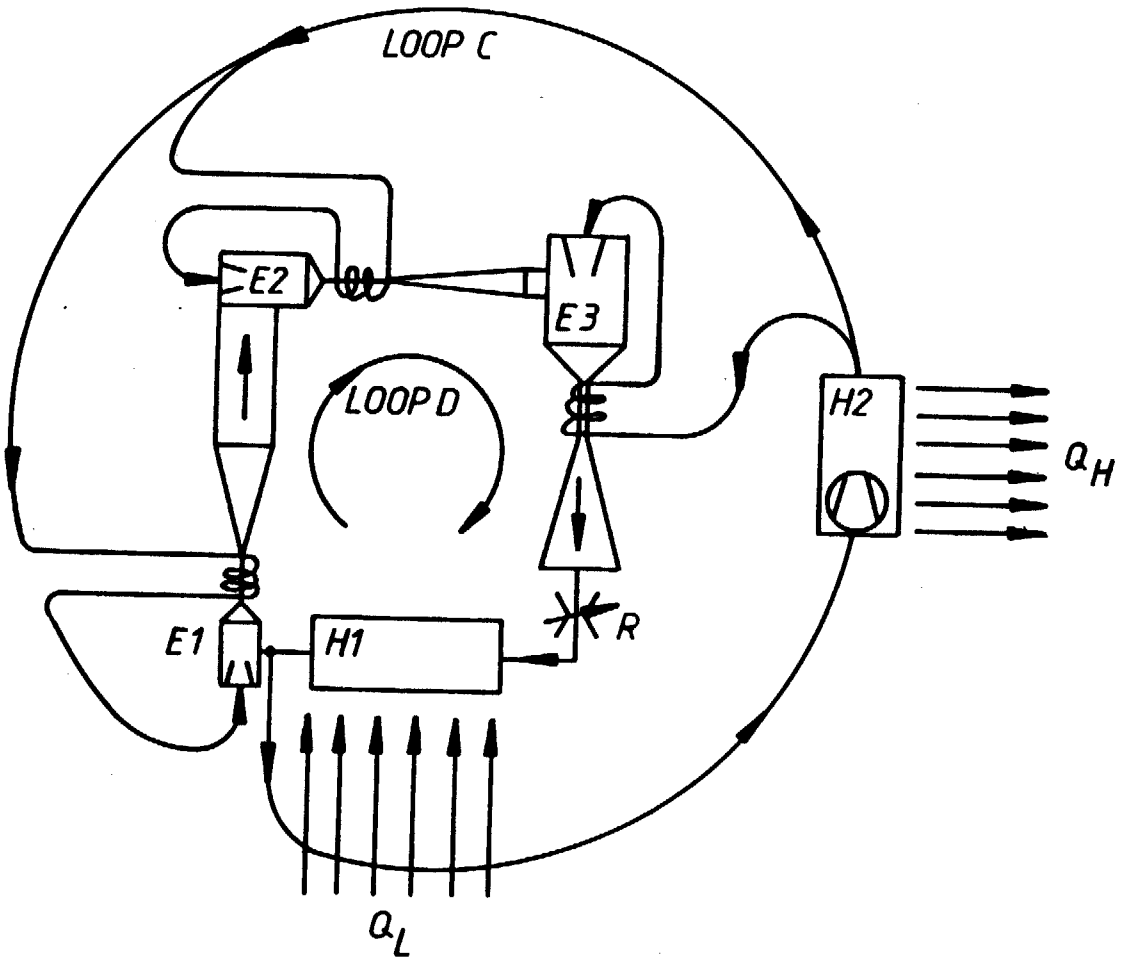
FIG. 6 shows a schematic drawing of a double loop-multi-stage jet ejector/compressor system.

FIG. 6 is a schematic drawing of a chemical heat pump system showing another embodiment of the present invention. In the drawing, symbol $H_2$ is an endothermic reactor/heat exchanger, $H_1$ is an exothermic reactor/heat exchanger, R is an expansion valve which may be controlled by a computer, C is a compressor (positive pressure), and $E_1$, $E_2$ and $E_3$ are staged jet ejectors (negative/slight positive pressure). The advantages of using jet ejectors instead of a vacuum compressor are lower capital (investment) costs, no moving parts, no maintenance, lower weight, in many cases lower operating costs, and last but not least, unlike most compressors being positive displacement pumps, based on displacing a volume, a jet ejector (injector) operates on a mass basis. The lower the mass of the fluid, the higher is the circulating speed, keeping total mass flow (almost) constant.

It can be seen in FIG. 6 that the system is divided into loop C and loop D, permitting a high circulating speed in the jet ejector loop D, combining a low circulating speed in the compressor loop C in one complete heat pump system. This is one of the strong points of this invention.

It can also be seen in FIG. 6 that the fluid streams coming from the compressor, before entering the ejectors, are wrapped around the throats of the ejectors. Since the throats are the coldest spots of the ejectors, due to high velocity and expansion of the working fluid, the fluid stream cools down the motive working fluid of the ejector, achieving lower motive fluid temperature, which causes higher ejector inlet suction performance although increasing all over performance of the system.

For active safety reasons there has been developed a special heat and noise insulating foam which carries a chemical agent in solid state. In case of leakage of the chemical reacting fluid ($NO_2$ ), which by penetrating odor, the $NO_2$ will react with the agent leaving completely harmless water and nitrogen.

Some passive safety devices are already available on the market, for example, $NO_2$ electronic sensors which warn and/or interrupt the running of the system if only a few PPM's of the used chemical reaction fluid are detected. Also, for passive security there is a dip-sensor available which corrodes in a short time, breaking an electric circuit allowing the compressor to stop and start an acoustic and/or optical alarm, when the reaction fluid reaches a water content of 3 (due to leak-in of wet air into the high vacuum part of the chemical heat pump system).

For lubricating of the compressor (if necessary), normal oils and greases cannot be used, while their lubricating quality brake down by contacting $NO_2$. There is already a $NO_2$ withstanding lubrication oil available for use in the chemical heat pump system.

It is thus seen there has been provided a unique chemical heat pump system which utilizes jet ejectors in an effective manner to reduce the capacity requirements of the compressor in the system.

While only certain preferred embodiments of this invention have been described it is understood that many variations are possible without departing from the principles of this invention as defined in the claims which follow.

What is claimed is:

1. In a chemical heat pump system comprising a. compressor and an exothermic reactor tank/heat exchanger formed into a main loop utilizing the chemical reaction heat of a perfectly reversible chemical dimerization reaction system having only one (gaseous) compound characterized by a controlled variable expansion valve and means for controlling the expansion of said valve as a function of the desired end temperatures of the system, the improvement comprising at least one jet ejector working in cooperation with said compressor.

2. The chemical heat pump system of claim 1 in which said jet ejector is in said main loop.

3. The chemical heat pump system of claim 1 in which said jet ejector is in a secondary loop which is separate from said main loop, permitting said jet ejector to establish a higher circulating speed than in the main loop, said variable expansion valve being in said secondary loop.

4. The chemical heat pump system of claim 3 having multiple jet ejector in said secondary loop.

5. A heat pump system comprising:

a. first heat exchanger means to supply heat from an outside heat source for causing the dissociation within said first heat exchanger means of a gas capable of reversible dissociation without any phase transition;

b. means separated from said first heat exchanger means for compressing the dissociation products of said first heat exchanger means without a phase transition and injecting under pressure the products into a second heat exchanger, the compression of said products within said second heat exchanger means causing the dissociation products to recombine and remain as a gas in an exothermic reaction giving off heat at a temperature which is higher than said heat source;

c. jet ejector means in series with and on the intake side of said compression means for precompressing said dissociation products;

d. expansion valve means for expanding to a lower temperature and pressure without a phase transition of the recombined gas leaving said second heat exchanger means;

e. means for delivering the expanded gas to said first heat exchanger means for repeating the cycle; and f. means for controlling the expansion of said expansion valve means in accordance with desired temperatures.

6. The heat pump compression system of claim 5 wherein said jet ejector means comprises a plurality of jet ejectors in series.

* * * * *